US009751727B1

(12) United States Patent
Novak

(10) Patent No.: US 9,751,727 B1
(45) Date of Patent: Sep. 5, 2017

(54) ELEVATOR ENTRY AND EXIT SYSTEM AND METHOD WITH EXTERIOR SENSORS

(71) Applicant: Precision Elevator Corp., Brooklyn, NY (US)

(72) Inventor: Yuri Novak, Staten Island, NY (US)

(73) Assignee: Precision Elevator Corp., Brooklyn, NY (US)

( * ) Notice: Subject to any disclaimer, the term of this patent is extended or adjusted under 35 U.S.C. 154(b) by 395 days.

(21) Appl. No.: 14/460,036

(22) Filed: Aug. 14, 2014

(51) Int. Cl.
*B66B 13/14* (2006.01)
*B66B 13/26* (2006.01)

(52) U.S. Cl.
CPC ..... *B66B 13/26* (2013.01)

(58) Field of Classification Search
CPC ..... B66B 13/26
USPC .... 187/313, 316, 317, 391, 392, 393; 49/26, 49/28; 318/466–470
See application file for complete search history.

(56) References Cited

U.S. PATENT DOCUMENTS

| | | | |
|---|---|---|---|
| 31,128 | A | 1/1861 | Otis |
| 3,367,450 | A | 2/1968 | Lester et al. |
| 4,029,176 | A | 6/1977 | Mills |
| 4,577,437 | A | 3/1986 | Gionet et al. |
| 4,621,452 | A | 11/1986 | Deeg |
| 4,732,238 | A | 3/1988 | Baumgartner |
| 4,753,323 | A | 6/1988 | Kahkipuro |
| 4,976,337 | A | 12/1990 | Trett |
| 5,284,225 | A | 2/1994 | Platt |
| 5,394,961 | A | 3/1995 | Biver |
| 5,518,086 | A | 5/1996 | Tyni |
| 5,627,439 | A | 5/1997 | Gregory et al. |
| 5,698,824 | A | 12/1997 | Platt |
| 6,051,829 | A | 4/2000 | Full |
| 6,386,326 | B2 | 5/2002 | Pustelniak et al. |
| 6,962,239 | B2 | 11/2005 | Shikai et al. |
| 6,973,998 | B2 | 12/2005 | Deplazes et al. |
| 7,093,692 | B2 | 8/2006 | Koura |

(Continued)

FOREIGN PATENT DOCUMENTS

JP 2010-18372 A 1/2010

OTHER PUBLICATIONS

Preliminary Report on Patentability issued in connection with PCT/US2013/053022.

(Continued)

*Primary Examiner* — Anthony Salata
(74) *Attorney, Agent, or Firm* — Pryor Cashman LLP

(57) ABSTRACT

An elevator car system and a method of operating an elevator door of an elevator car include an elevator car configured to travel between and stop on a plurality of floors, the elevator car having a door capable of opening and closing along a pathway, a first obstruction sensor disposed on or within the door configured to detect a first obstruction in the pathway, a supplemental obstruction sensor located on a floor of the plurality of floors, and located external to both the elevator car and the door, the supplemental obstruction sensor configured to detect a second obstruction, and wherein closing of the door is prevented or modified based on at least one of: the first obstruction sensor having detected the first obstruction, and the supplemental obstruction sensor having detected the second obstruction on the floor external to the elevator car and the door when the elevator car is substantially stopped and located on the floor.

20 Claims, 7 Drawing Sheets

(56) References Cited

U.S. PATENT DOCUMENTS

| | | | | |
|---|---|---|---|---|
| 7,140,469 | B2 | 11/2006 | Deplazes et al. | |
| 7,165,655 | B2 | 1/2007 | Cook et al. | |
| 7,992,687 | B2 | 8/2011 | Yumura et al. | |
| 8,510,990 | B2 | 8/2013 | Agam et al. | |
| 8,904,708 | B2 | 12/2014 | Zacchio et al. | |
| 9,212,028 | B2 * | 12/2015 | Novak | B66B 13/26 |
| 2011/0056134 | A1 | 3/2011 | Zacchio et al. | |
| 2014/0034426 | A1 | 2/2014 | Novak | |

OTHER PUBLICATIONS

Written Opinion of the International Searching Authority in PCT/US2015/043993 (Mar. 28, 2016).

International Preliminary Report on Patentability Chapter I in PCT/US2015/043993 (Feb. 14, 2017).

* cited by examiner

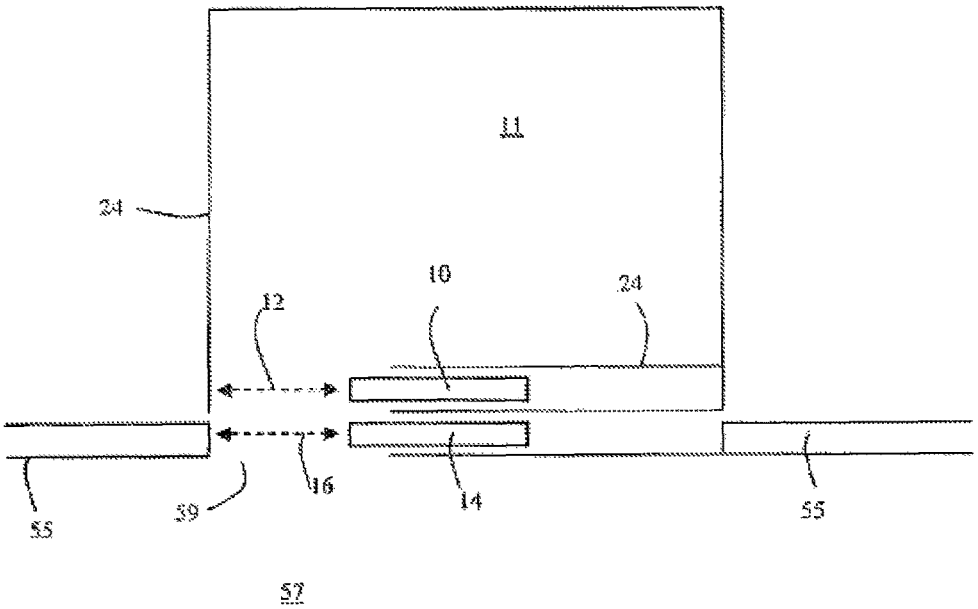
Figure 1A *(Prior Art)*
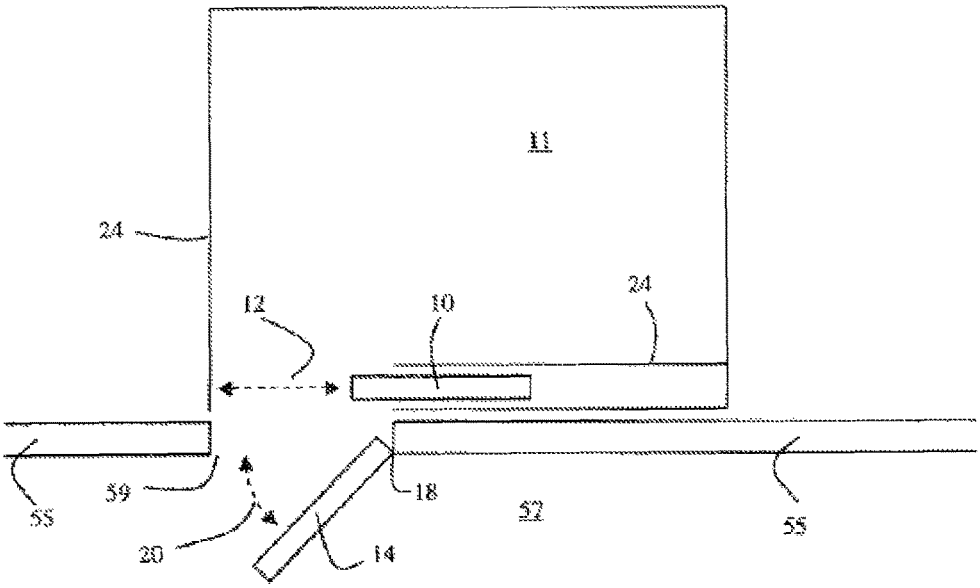
Figure 1B *(Prior Art)*

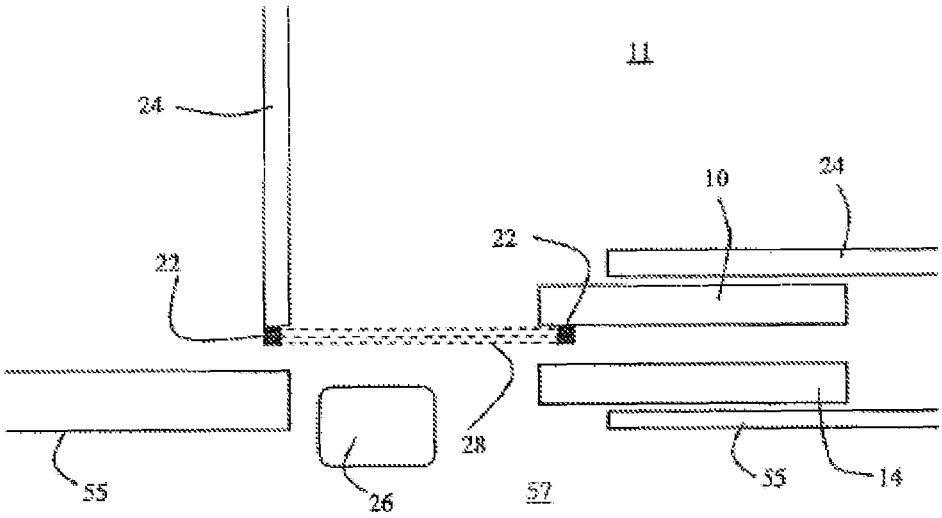
Figure 2 *(Prior Art)*
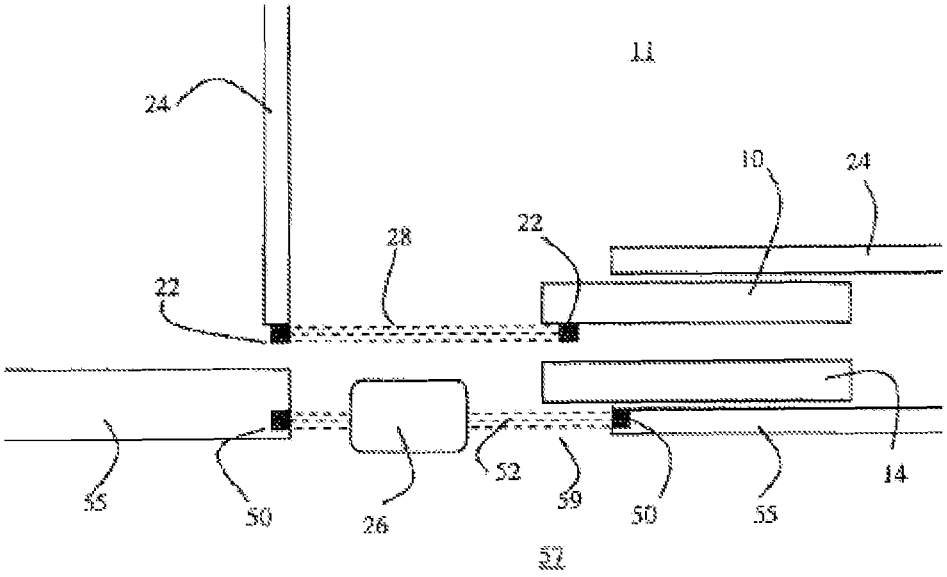
Figure 3

ELEVATOR ENTRY AND EXIT SYSTEM AND METHOD WITH EXTERIOR SENSORS

TECHNICAL FIELD

This invention relates to sensors for detecting the presence of persons or other obstructions near elevator doors and doorways.

DESCRIPTION OF RELATED ART

For many decades, elevators have served as essential fixtures in commercial, residential and industrial buildings, ferrying people and materials between floors and making possible the vertical expansion of cities. Since the introduction of elevators, Safety has been a primary concern in the design, installation and operation of elevators. Elevator safety features include Elisha Otis' safety brake intended to keep an elevator car from plummeting in the event of a broken hoist rope. Later elevator safety concerns focused on the separation of elevator doors.

Elevator doors have been a particular concern in elevator safety, owing to the increased potential for personal injury and property damage in the event of their improper operation or failure. In particular, much effort has been focused on controlling the automatic closure of elevator doors while a person or obstruction is in the path of the doors' movement. For example, many different types of sensors have been developed to detect the presence of a person or object in the path of a closing door or in proximity thereto.

In addition to mechanical sensors, which sense when a door strikes an object, electrical sensors of many types have been developed to sense the presence of an obstruction before the door has a chance to contact the obstruction. For example, sensors have been proposed that detect the obstruction or reflection of visible or non-visible light in the pathway of an elevator door (see, for example, U.S. Pat. Nos. 4,621,452, 5,394,961, and 6,973,998, all of which are incorporated by reference herein in their entireties), the reflection of acoustic energy from obstructions in the pathway of an elevator door (see, for example, U.S. Pat. No. 4,029,176, which is incorporated by reference herein in its entirety), the response from antennas placed opposite an open elevator car doorway to changed capacitance therebetween in the presence of an obstruction (see, for example, U.S. Pat. Nos. 4,732,238 and 4,753,323, both of which are incorporated by reference herein in their entireties) and the presence of people or obstructions in a lobby area outside an elevator door (see, for example, U.S. Pat. No. 5,518,086, which is incorporated by reference herein in its entirety).

However, the implementation of such sensors is often limited to the immediate pathway of an elevator car door or an elevator shaftway door. Such limitation, while economical, has left a need for a more considered approach to elevator door safety.

SUMMARY

This invention relates to elevator door systems, elevator obstruction sensors, and methods of operation for elevator doors.

In general, in one aspect, the invention features an elevator car system, including an elevator car configured to travel between and stop on a plurality of floors, the elevator car having a door capable of opening and closing along a pathway. A first obstruction sensor is disposed on or within the door configured to detect a first obstruction in the pathway. A supplemental obstruction sensor is located on a floor of the plurality of floors, and located external to both the elevator car and the door, the supplemental obstruction sensor configured to detect a second obstruction. The closing of the door is prevented or modified based on at least one of: the first obstruction sensor having detected the first obstruction, and the supplemental obstruction sensor having detected the second obstruction on the floor external to the elevator car and the door when the elevator car is substantially stopped and located on the floor.

Implementations of the invention may include one or more of the following features. The elevator car system may further include one or more processors communicatively coupled to the first obstruction sensor and the supplemental obstruction sensor for causing the preventing or modifying of the closing of the door. The floor may have at least one wall adjacent to the pathway and external to both the elevator car and the door, and the supplemental obstruction sensor located on or within the at least one wall. The first obstruction sensor may be located within a recessed channel.

The floor external to the elevator car and the door may have an entryway defined by a first wall and a second wall and configured to provide a user access to the elevator car interior when the door is in an open configuration, and the supplemental obstruction sensor including a transmitter and a receiver disposed on at least one of the first wall or the second wall and configured to detect an obstruction in the entryway. The supplemental obstruction sensor may include a transmitter for transmitting a signal and a receiver for receiving the signal, and the supplemental obstruction sensor configured to transmit an obstruction indication based on determining that the receiver has not received the signal during a predetermined period of time. The supplemental obstruction sensor may be communicatively coupled to at least one elevator car sensor and configured to transmit an obstruction indication based on determining that the elevator car is substantially stopped and located within a predetermined distance from the elevator car sensor. The supplemental obstruction sensor may be a first supplemental obstruction sensor, and the elevator car system includes one or more second supplemental obstruction sensors located on the other floors of the plurality of floors.

In general, in another aspect, the invention features a method of operating an elevator door of an elevator car, the elevator car configured to travel between and stop on a plurality of floors, the elevator door capable of opening and closing along a pathway. An instruction is received to close the elevator door. A proximate obstruction is detected based on determining that the elevator car is substantially stopped and located on a floor of the plurality of floors and, by a supplemental obstruction sensor, detecting an obstruction on the floor external to both the elevator car and the elevator door. The instruction is modified or overridden based on detecting the proximate obstruction.

Implementations of the invention may include one or more of the following features. Determining the proximate obstruction may include determining that the supplemental obstruction sensor has detected an obstruction on the floor external to the elevator car and the door, and upon determining that the supplemental obstruction sensor has detected the proximate obstruction, determining that the elevator car is substantially stopped and located on the floor. Determining the proximate obstruction may include determining that the elevator car is substantially stopped and located on the floor, and upon determining the elevator car is substantially stopped and located on the floor, determining that the supplemental obstruction sensor has detected the proximate obstruction on the floor external to the elevator car and the door. Determining the proximate obstruction may include receiving detection input indicating that the supplemental obstruction sensor has detected the proximate obstruction on the floor, receiving location input indicating that the elevator car is substantially stopped and located on the floor, and determining that the elevator is stopped and located on the floor having the proximate obstruction based on the detection input and the location input.

Each floor of the plurality of floors may have an entryway defined by a first wall and a second wall and configured to provide a user access to the elevator car interior when the door is in an open configuration, and the supplemental obstruction sensor including a transmitter and a receiver disposed on at least one of the first wall or the second wall and configured to detect when an obstruction is in the entryway. The first obstruction sensor may be in a recessed channel.

In general, in another aspect, the invention features a method of operating an elevator door of an elevator car, the elevator car configured to travel between and stop on a plurality of floors, the elevator door capable of opening and closing along a pathway, and each of the plurality of floors has an external portion adjacent to the pathway and external to both the elevator car and the elevator door. An instruction is received to close the elevator door. It is determined whether a first obstruction sensor has detected a first obstruction. It is determined whether both a supplemental obstruction sensor has detected a second obstruction on a floor of the plurality of floors and the elevator car is substantially stopped at the floor. The closing of the elevator door is prevented or modified based on at least one of: determining that the first obstruction sensor has detected the first obstruction, and determining that the supplemental obstruction sensor has detected the second obstruction on the floor and the elevator car is substantially stopped on the floor.

Implementations of the invention may include one or more of the following features. Determining whether both the supplemental obstruction sensor has detected the second obstruction on the floor and the elevator car is substantially stopped and located on the floor may include determining whether the supplemental obstruction sensor has detected an obstruction on any of the floors of the plurality of floors, and based on determining that the supplemental obstruction sensor has detected an obstruction, determining if the elevator car is substantially stopped and located on the floor.

The method may further include receiving location input from an elevator car sensor indicating a position and speed of the elevator car, receiving obstruction input from the supplemental obstruction sensor indicating an obstruction proximate to the supplemental obstruction sensor, determining that the supplemental obstruction sensor has detected an obstruction on the floor at which the elevator car is substantially stopped, and the determining whether both the supplemental obstruction sensor has detected the obstruction on the floor and the elevator car is substantially stopped on the floor is based on receiving the obstruction signal. For each floor of the plurality of floors, the external portion may include an entryway defined by a first wall and a second wall and configured to provide a user access to the elevator car interior when the door is in an open configuration, the supplemental obstruction sensor including a transmitter and a receiver disposed on at least one of the first wall or the second wall and configured to detect when an obstruction is in the entryway. The first obstruction sensor may be disposed in a recessed channel. The supplemental obstruction sensor may include a transmitter for transmitting a signal, a receiver for receiving the signal, and at least one elevator car sensor for detecting a location of the elevator car, and the supplemental obstruction sensor configured to transmit an obstruction indication based on determining that the receiver has not received the signal during a predetermined period of time and the elevator car is substantially stopped and located within a predetermined distance from the elevator car sensor.

BRIEF DESCRIPTION OF THE DRAWINGS

The above mentioned and other aspects, features and advantages can be more readily understood from the following detailed description with reference to the accompanying drawings, wherein:

FIGS. 1A and 1B are partial top views of prior art elevator configurations;

FIG. 2 is a partial top view of a prior art elevator door and sensor configuration;

FIG. 3 is a partial top view of an elevator door and sensor configuration according to an exemplary embodiment of the present invention;

DETAILED DESCRIPTION

Figure 4:
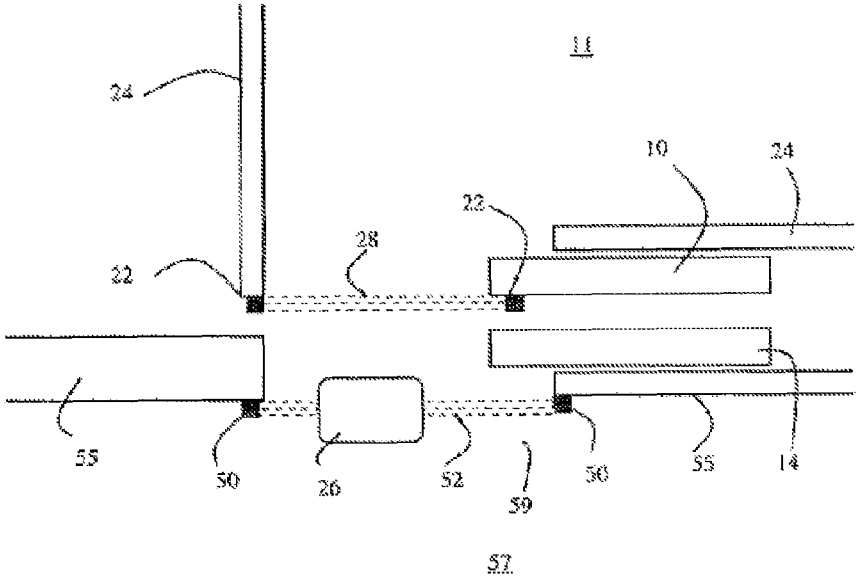
FIG. 4 is a partial top view of an elevator door and sensor configuration according to another exemplary embodiment of the present invention.

Supplemental elevator door sensors, elevator door systems, and methods of operation for elevator doors are described herein, with reference to examples and exemplary embodiments. Specific terminology is employed in describing examples and exemplary embodiments. However, the disclosure of this patent specification is not intended to be limited to the specific terminology so selected and it is to be understood that each specific element includes all technical equivalents that operate in a similar manner.

FIGS. 1A and 1B illustrate typical ways in which an elevator car 24 may be incorporated into a structure (e.g., a building structure). While the current disclosure describes the structure as a building, those skilled in the art will appreciate that the discussion of the building is exemplary and that the elevator may be incorporated into any type of structure. The building may comprise a lobby area 57 adjacent an elevator and at least partially defined by one or more building walls 55. The one or more building walls 55 may comprise an entryway 59 for providing access between the lobby area 57 and an elevator car interior 11.

FIGS. 1A and 1B show typical elevator door configurations. As shown, elevator doors typically include at least a pair of doors, namely an elevator car door 10 and an elevator shaftway door 14 (referred to herein as a car door and a shaftway door, respectively, and as elevator doors collectively). Car doors 10 are typically configured to slide back and forth along a straight track or path 12. Shaftway doors 14 may be configured to slide along with the car doors 10 in a parallel track or path 16 or may be configured to swing open at a hinge point 18 in an arcuate path 20. Elevator doors may be manual or may be motorized. In one configuration, car doors are driven by an electric motor through a mechanical linkage, and shaftway doors are mechanically engaged with the car doors so that they open and close together.

Elevator doors are typically provided with obstruction sensors, as discussed above. Obstruction sensor technology and sensor designs for elevator doors are well known in the art and may take many forms, some of which are discussed above. In the present application, the term obstruction sensor is used generally to refer to any compatible obstruction sensor and is not intended to limit the discussion to any particular sensor type or sensing technology, unless explicitly stated otherwise. Previously, a single obstruction sensor (sometimes comprising several components) was configured at an elevator door opening to detect an obstruction in the immediate path of the elevator doors. For example, as shown in FIG. 2, an obstruction sensor 22 may include components placed on the outside of a car door 10 and opposite the door opening, on the side of elevator car 24. When an obstruction is present between obstruction sensor 22 components, the elevator doors may be programmed to operate in a different manner, e.g. remain open or close at a slower speed.

However, in such previous configurations, there remained a danger that an obstruction may still be in the way of the closing car or shaftway doors, even if such obstruction is not detected by obstruction sensor 22. For example, as shown in FIG. 2, obstruction 26 is not within the sensing zone 28 of obstruction sensor 22 components, even though it would be struck by shaftway door 14 if the car door were to begin closing.

In an exemplary embodiment, shown in FIG. 3, an elevator door system with a sliding car door 10 is shown with a first obstruction sensor 22 and a supplemental obstruction sensor 50 provided in an area adjacent to the entryway 59 and inside the building wall 55, i.e., external to the elevator car 24 with respect to shaftway door 14. As shown, obstruction is detected by supplemental obstruction sensor 50, as the obstruction extends into the sensing zone 52 of supplemental obstruction sensor 50.

In another exemplary embodiment, shown in FIG. 4, instead of or in addition to a supplemental obstruction sensor 50 being disposed inside the building wall 55, a supplemental obstruction sensor 50 may be provided in an area adjacent the building wall 55. For example, in the embodiment shown in FIG. 4, a supplemental obstruction sensor 50 is disposed on a surface of the building wall 55 and within the lobby area 57. A supplemental obstruction sensor 50 located in the lobby area 57 may afford extra safety as it detects an obstruction that is proximate to the elevator doors, even if the obstruction is not in the direct pathway thereof. To protect the supplemental obstruction sensor 50 from damage, the supplemental obstruction sensor 50 may be disposed on a lower portion of the building wall 55 (e.g., near foot level). In some embodiments, the supplemental obstruction sensor 50 may be placed on the opposite side of the building wall 55 than that shown in FIG. 4 such that the supplemental obstruction sensor 50 is disposed between the building wall 55 and the shaftway door 14. In some embodiments, the lobby area 57 may include a light (not shown) configured to illuminate when the supplemental obstruction sensor 50 detects an obstruction to thereby notify those in the lobby area 57 that a person or object is activating the supplemental obstruction sensor 50.

While the examples of obstruction sensors are shown at right and left sides of an elevator door opening, one skilled in the art will recognize that one or more obstruction sensors may be placed at the top and/or bottom of the door opening instead of or in addition to placement at the sides of the door opening. Likewise, one skilled in the art will recognize that obstruction sensors may comprise a single component or any number of multiple components.

Figure 5:
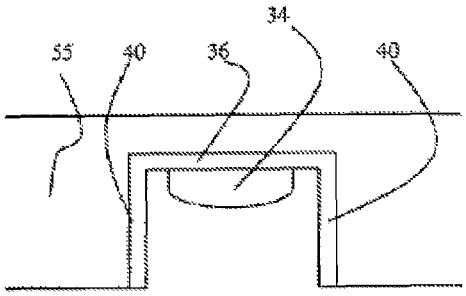
FIG. 5 is a top profile view of an installed elevator obstruction sensor apparatus according to an exemplary embodiment of the present invention.
Figure 6:
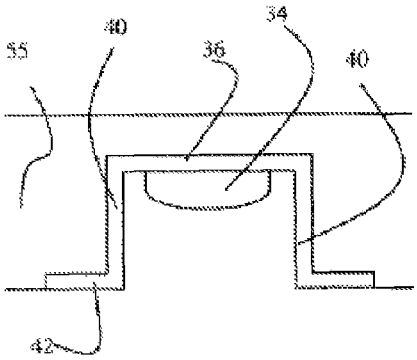
FIG. 6 is a top profile view of an installed elevator obstruction sensor apparatus according to another exemplary embodiment of the present invention.

In one exemplary embodiment, shown in FIG. 5, a supplemental obstruction sensor 50 component may include an elongated channel and a sensing element 34 provided in the trough 36 of the channel. In some embodiments, the channel may be installed in the wall 55 of the building structure, or any other structure such that the elongated channel and sensing element 34 are recessed from the surface of an adjacent structure. In such an example, the sensing element 34 may be protected from damage caused by persons or objects striking the structure adjacent the channel. The channel may be provided with a "C"-shaped profile with a trough bottom 34 and legs 40, as shown in FIG. 5, or may be provided with flanges 42 extending from the legs 40, as shown in FIG. 6.

In one example, a supplemental obstruction sensor 50 may include two sensor components arranged opposite from one another across an entryway 59. One obstruction sensor component may comprise a sensing element 34 provided with one or more infrared (IR) emitters and the opposite sensor component may comprise a sensing element 34 provided with one or more complimentary IR light receivers. Alternatively or additionally, one of the sensing elements 34 may include one or more IR light emitters and complementary IR light receivers, and the opposite sensor element 34 may comprise an IR light reflective surface. Such an obstruction sensor may be configured to detect the presence of an obstruction when the IR light emitted by the IR emitter is not received by the IR receiver, the IR being blocked by a detected obstruction. It will be readily apparent to those skilled in the art that the sensing element 34 need not comprise an infrared sensing means and that any type or types of sensing means (e.g., ultrasonic, microwave, tomographic, capacitive, etc.) may be used instead of or in addition to the infrared sensing means, while remaining within the scope of the current disclosure.

The supplemental obstruction sensor 50 may be incorporated into elevator door systems comprising any additional types of sensors. For example, in some embodiments, the elevator door system may comprise a first obstruction sensor, a second obstruction sensor located in an area adjacent to and inside the car door 10 (e.g., internal to the elevator car with respect to the car door), as well as a supplemental obstruction sensor 50. Such a second obstruction sensor is described U.S. patent application Ser. No. 13/563,334, which is incorporated by reference herein in its entirety.

The sensing element 34 may be communicatively and electrically coupled, e.g., by providing a signal, to a processor and a door motor to control a configuration of the elevator doors. For example, when the receiving element detects that it is not receiving the signal from the emitting element (e.g., when the IR light receiver detects that it is not receiving IR light from the IR emitting element), then the sensing element 34 may send a detection signal to the processor. Upon receiving the detection signal from the sensing element, the processor may command the door motor to operate the elevator doors in a different manner (e.g., maintain the doors in an open configuration or close the elevator doors more slowly after receiving an instruction to close the elevator doors).

In some embodiments, the elevator door system may comprise safety means for preventing movement of the elevator doors when such movement would pose a safety risk and/or hinder the operability of the elevator system. For example, if the elevator car 24 is not currently stopped at a particular floor, then opening the elevator doors could lead to persons or objects falling down the elevator shaft and/or injury to those in the elevator interior 11. Also, if the elevator has not reached a complete stop, then opening the elevator doors can be gravely dangerous. Furthermore, if obstructions located on different floors than the elevator car 24 cause the elevator car 24 to stall, operation of the elevator system can be highly inefficient. Therefore, the current disclosure provides safety means for situations when persons or objects obstruct the supplemental obstruction sensor's 50 sensing zone 52 when the elevator doors should not open (e.g., when the elevator car is not located at the same floor as where the obstruction is taking place and/or when the elevator car has not come to a complete stop).

In some embodiments, the safety means involves a supplemental obstruction sensor 50 that is configured to send a detection signal to the processor only if the elevator car 24 is stopped on the floor at which the obstruction is located. The supplemental obstruction sensor 50 may comprise a processor and may receive data indicative of the elevator car's 24 location through any means. For example, the supplemental obstruction sensor 50 may receive data indicative of the elevator car's 24 location from another component of the elevator system. As another example, the supplemental obstruction sensor 50 may comprise a sensing element (e.g., the sensing element 34 or an additional sensing element) configured to detect whether or not the elevator car 24 is stopped on the same floor as the obstruction. Thus, upon detecting an obstruction, the supplemental obstruction sensor 50 may be configured to send a detection signal to the processor only if the supplemental obstruction sensor 50 also determines that the elevator car is stopped on the same floor as the obstruction.

In some embodiments, the safety means comprises a processor that is configured to receive a detection signal from a supplemental obstruction sensor 50 and determine a floor on which the obstruction is located (e.g., by determining a floor on which supplemental obstruction sensor's 50 sensing zone 52 is located). The processor may also be configured to receive data indicating a particular floor on which the elevator car 24 is stopped. Thus, the processor may be configured to determine whether or not the elevator car 24 is stopped on the same floor as the detected obstruction.

In some embodiments, the processor may determine whether or not an elevator car 24 is stopped, and if so, the floor on which it is stopped. Based on determining that the elevator is stopped on the particular floor, the processor may then determine whether a supplementary obstruction sensor 50 having a sensing zone 52 on the particular floor has detected an obstruction. In this manner, the processor may be configured to process a detection signal from a supplemental obstruction sensor 50 only if the elevator car is stopped on the same floor as the supplemental obstruction sensor's 50 sensing zone 52. In turn, the processor may activate the motor to control the elevator door configuration (e.g., maintain the elevator doors in an open position, close the elevator doors more slowly, etc.) only if the obstruction occurs on the same floor as where the elevator car 24 is stopped.

In other embodiments, the processor may determine whether an obstruction has been detected by any of the supplemental obstruction sensors 50 located on any of the floors, and if so, the processor may determine the location of the detected obstruction (e.g., by determining the location of the supplemental obstruction sensor's 50 sensing zone). The processor may then determine whether or not the elevator car 24 is stopped on the same floor as the obstruction. In turn, the processor may activate the motor to control the elevator door configuration (e.g., maintain the elevator doors in an open position, close the elevator doors more slowly, etc.) only if the obstruction occurs on the same floor as where the elevator car 24 is stopped.

Figure 7:
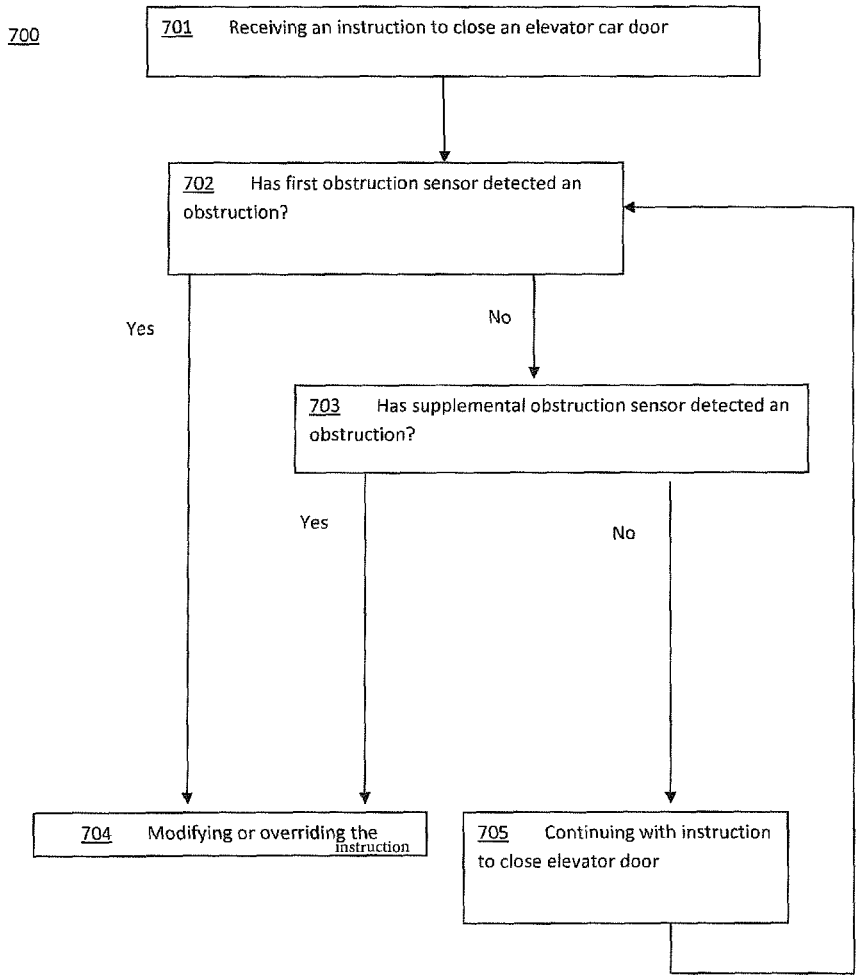
FIG. 7 is a flow diagram of a method of operation for elevator doors according to an exemplary embodiment of the present invention.

The provision of one or more supplemental obstruction sensors in addition to a first obstruction sensor allows for new methods of operation for elevator doors. For example, in one exemplary embodiment, shown in FIG. 7, a method 700 of operation for elevator doors includes receiving an instruction to close doors 701, determining if a first obstruction sensor senses an obstruction 702, determining if a supplemental obstruction sensor senses an obstruction 703. If neither the first obstruction sensor nor the supplemental obstruction sensor senses an obstruction, then the method moves to continuing with the instruction to close the elevator door 705 and looping back to step 702. If either the first obstruction sensor or the supplemental obstruction sensor senses an obstruction, the instruction to close the elevator car door is either modified (e.g., the door motor is instructed to close the doors at a slower speed) or the instruction to close the elevator car door is overridden (e.g., the door motor is not instructed to close the doors).

Figure 8:
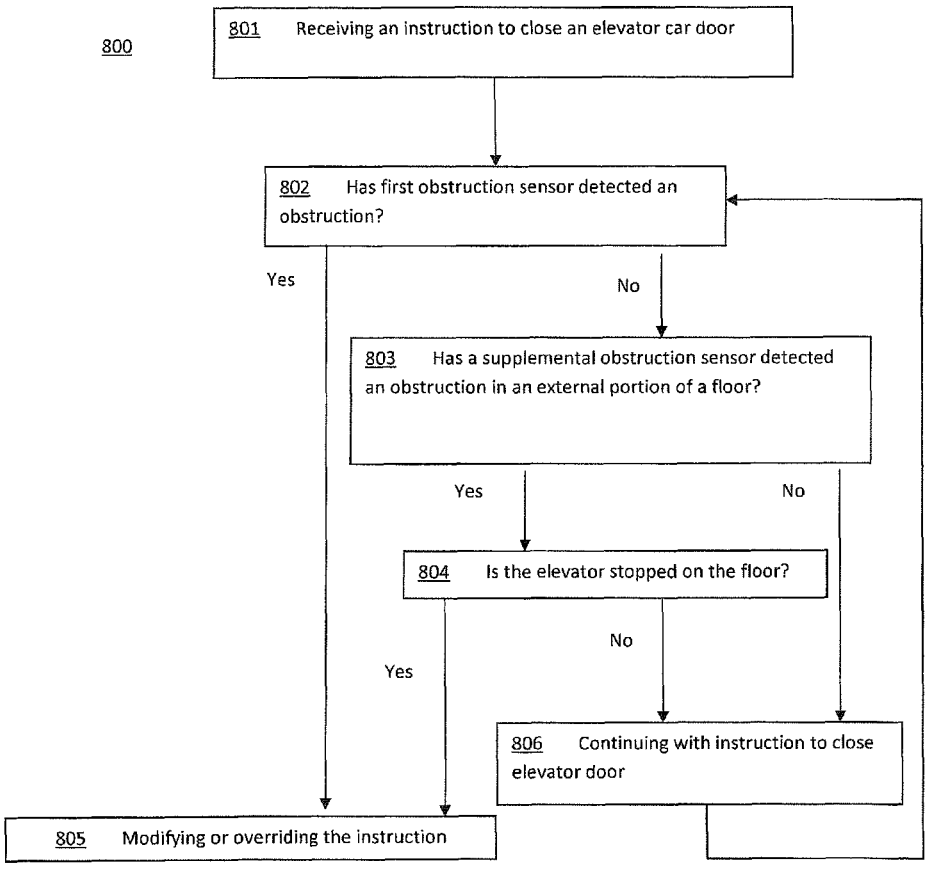
FIG. 8 is a flow diagram of a method of operation for elevator doors according to another exemplary embodiment of the present invention.

FIG. 8 shows a method of operation for elevator doors comprising an embodiment of safety means. In the exemplary embodiment shown in FIG. 8, the method includes receiving an instruction to close an elevator car door 801 and determining if a first obstruction sensor has detected an obstruction 802. If the first obstruction sensor has detected an obstruction, then the method moves to modifying or overriding the instruction to close the elevator car door 805. If, on the other hand, the first obstruction sensor has not detected an obstruction, then the method moves to determining if a supplemental obstruction sensor has detected an obstruction in an external portion of a floor 803. If the supplemental obstruction sensor has not sensed an obstruction, then the instruction to close the elevator door is continued 806 and the method loops to step 802. If the supplemental obstruction has sensed an obstruction, then it is determined if the elevator is stopped on the same floor as the detected obstruction 804. If the elevator is not stopped on the same floor as the detected obstruction, the instruction to close the elevator door is continued 806 and the method loops back to step 802. If the elevator is stopped on the same floor as the detected obstruction, then the instruction to close the elevator door is modified or overridden 805.

The method shown in FIG. 8 may be performed by one or more processors. In some embodiments, upon a first processor determining a first obstruction sensor has not detected an obstruction, the first processor determines if a supplemental obstruction sensor has detected an obstruction on a floor, and upon determining the supplemental obstruction has detected an obstruction on a floor, the first processor transmits a signal to a second processor, which determines if the elevator is stopped on the floor on which the obstruction was detected. Upon the second processor determining the elevator is stopped on the floor, the second processor modifies or overrides the instruction by commanding the door motor to operate the elevator doors in a different manner (e.g., maintain the doors in an open configuration or close the elevator doors more slowly) or transmitting information to one or more third processors for commanding the door motor. In other embodiments, a single processor determines if a first obstruction sensor has detected an obstruction, and upon determining the first obstruction sensor has not detected an obstruction, determines if a supplemental obstruction sensor has detected an obstruction. Upon determining the supplemental obstruction sensor has detected an obstruction on a floor, the processor determines if the elevator car is stopped on the floor on which the obstruction was detected. Upon the processor determining the elevator is stopped on the floor, the processor modifies or overrides the instruction by commanding the door motor to operate the elevator doors in a different manner (e.g., maintain the doors in an open configuration or close the elevator doors more slowly) or by transmitting information to one or more second processors for modifying or overriding the instruction.

Figure 9:
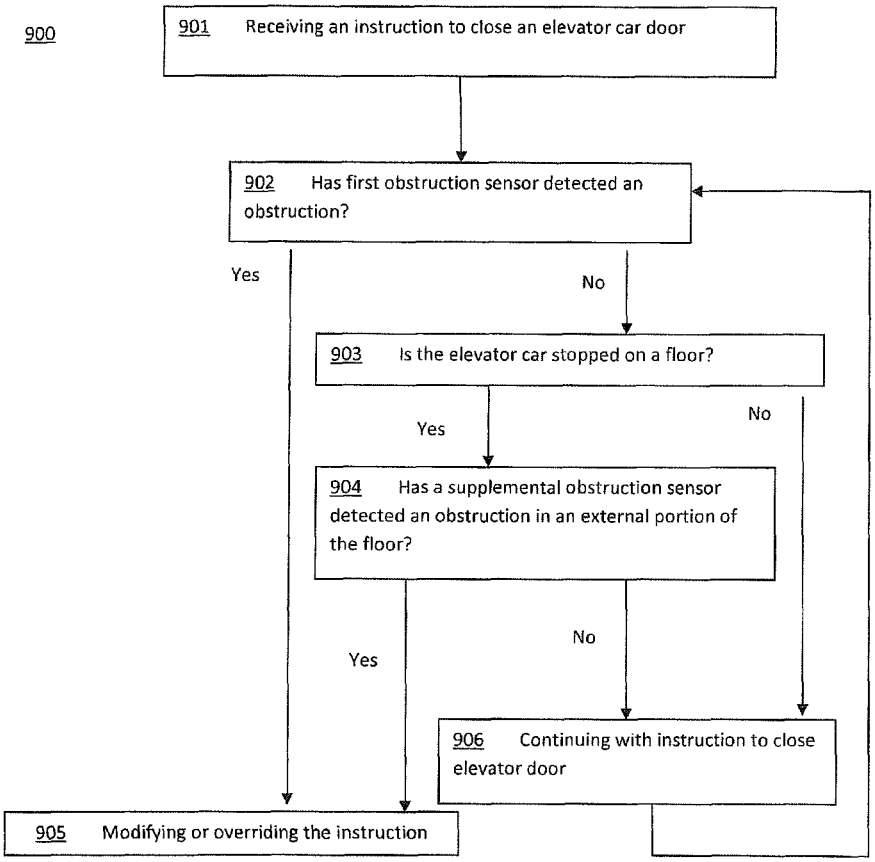
FIG. 9 is a flow diagram of a method of operation for elevator doors according to yet another exemplary embodiment of the present invention.

FIG. 9 shows another method of operation for elevator doors comprising another embodiment of safety means. In the exemplary embodiment shown in FIG. 9, the method includes receiving an instruction to close elevator doors 901, and determining if a first obstruction sensor senses an obstruction 902. If the first obstruction sensor has detected an obstruction, then the method moves to modifying or overriding the instruction to close the elevator car door 905. If, on the other hand, the first obstruction sensor has not detected an obstruction, then the method moves to determining if the elevator car is stopped on a floor 903. If the elevator car is not stopped on a floor, then the instruction to close the elevator door is continued 906 and the method loops back to step 902. If the elevator car is stopped on a floor, then the method moves to determining if a supplemental obstruction sensor has detected an obstruction in an external portion of the floor on which the elevator car is stopped 904. If the supplemental obstruction sensor has not detected an obstruction on the floor, then the instruction to close the elevator door is continued 906 and the method loops back to step 902. If the supplemental obstruction sensor has detected an obstruction in an external portion of the floor on which the elevator car is stopped, then the instruction to close the elevator door is modified or overridden 905.

The method shown in FIG. 9 may be performed by one or more processors. In some embodiments, upon a first processor determining a first sensor has not detected an obstruction, the first processor determines if the elevator car is stopped on a floor, and upon determining the elevator car is stopped on a floor, transmits a signal to a second processor, which then determines if a supplemental obstruction sensor has detected an obstruction on the floor. Upon the second processor determining a supplemental obstruction sensor has detected an obstruction on the floor on which the elevator is stopped, the second processor may command the door motor to operate the elevator doors in a different manner (e.g., maintain the doors in an open configuration or close the elevator doors more slowly) or the second processor may transmit a signal to one or more third processors for commanding the door motor. In other embodiments, a single processor determines if a first obstruction sensor has detected an obstruction and upon determining the first obstruction sensor has not detected an obstruction, determines if the elevator car is stopped on a floor. Upon determining the elevator car is stopped on a floor, the processor determines if a supplemental obstruction sensor has detected an obstruction on the floor. Upon the processor determining an obstruction was detected on the floor on which the elevator car is stopped, the processor modifies or overrides the instruction by commanding the door motor to operate the elevator doors in a different manner (e.g., maintain the doors in an open configuration or close the elevator doors more slowly) or by transmitting a signal to one or more second processors for commanding the door motor.

Figure 10:
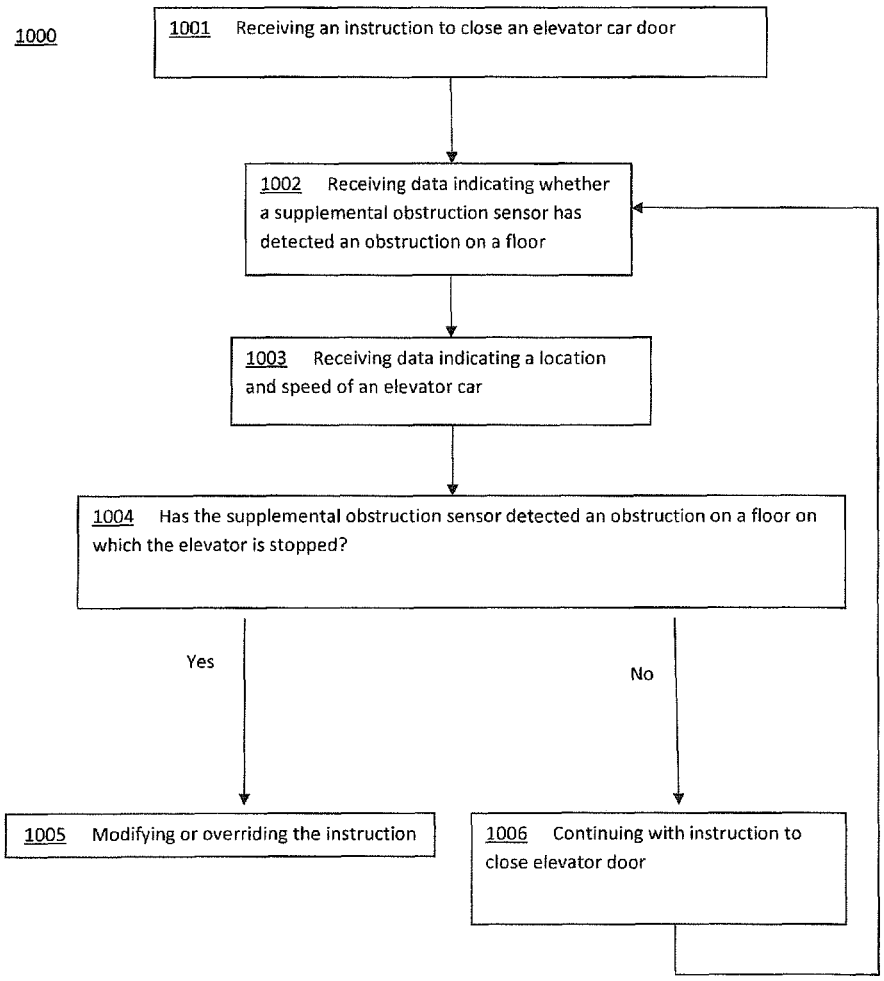
FIG. 10 is a flow diagram of a method of operation for elevator doors according to yet another exemplary embodiment of the present invention.

FIG. 10 shows a method of operating elevator doors comprising an embodiment of safety means. In the exemplary embodiment shown in FIG. 10, the method includes receiving an instruction to close an elevator car door 1001, receiving obstruction data indicating whether a supplemental obstruction sensor has detected an obstruction on a floor 1002, receiving location data indicating a location and speed of an elevator car 1003, and based on the received obstruction data and location data, determining if both the elevator is stopped on a floor and the supplemental obstruction sensor has detected an obstruction on the floor 1004. If the supplemental obstruction sensor has not detected an obstruction on the floor on which the elevator is stopped, then the instruction to close the elevator door is continued 1006 and the method loops back to step 1002. If the supplemental obstruction sensor has detected an obstruction in an external portion of the floor on which the elevator car is stopped, then the instruction to close the elevator door is modified or overridden 1005.

The method shown in FIG. 10 may be performed by one or more processors. In some embodiments, a first processor (e.g., a processor included in the supplemental obstruction sensor) receives the obstruction data and location data and makes the determination. Upon the first processor determining an obstruction has been detected on a floor on which the elevator is stopped, the first processor transmits a signal to a second processor for modifying or overriding the instruction. The second processor then modifies or overrides the instruction by commanding the door motor to operate the elevator doors in a different manner (e.g., maintain the doors in an open configuration or close the elevator doors more slowly) or transmitting a signal to one or more other processors for commanding the door motor. In some embodiments, a single processor receives the obstruction data and location data, makes the determination, and modifies or overrides the instruction. For example, the same processor that receives the obstruction data and location data and makes the determination may also command the door motor to operate the elevator doors in a different manner.

In any of the above method examples, an instruction to close the doors may, for example, be the result of a button push by an operator of the elevator or may result from a predetermined amount of time having elapsed since the doors were opened. Also, in any of the above method examples, the supplemental obstruction sensor may be placed inside the building wall and/or may be provided in an area adjacent the building wall.

In addition, the embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted for each other within the scope of this disclosure.

What is claimed is:

1. An elevator car system, comprising:

an elevator car configured to travel between and stop on a plurality of floors, the elevator car having a door capable of opening and closing along a pathway;

a first obstruction sensor disposed on or within the door configured to detect a first obstruction in the pathway;

a supplemental obstruction sensor located on a floor of the plurality of floors, and located external to both the elevator car and the door, the supplemental obstruction sensor configured to detect a second obstruction; and wherein closing of the door is prevented or modified based on at least one of: the first obstruction sensor having detected the first obstruction, and the supplemental obstruction sensor having detected the second obstruction on the floor external to the elevator car and the door when the elevator car is substantially stopped and located on the floor.

2. The elevator car system of claim 1, further comprising one or more processors communicatively coupled to the first obstruction sensor and the supplemental obstruction sensor for causing the preventing or modifying of the closing of the door.

3. The elevator car system of claim 1, wherein the floor has at least one wall adjacent to the pathway and external to both the elevator car and the door, and the supplemental obstruction sensor is located on or within the at least one wall.

4. The elevator car system of claim 1, wherein the first obstruction sensor is located within a recessed channel.

5. The elevator car system of claim 1, wherein the floor external to the elevator car and the door has an entryway defined by a first wall and a second wall and configured to provide a user access to the elevator car interior when the door is in an open configuration, and wherein the supplemental obstruction sensor comprises a transmitter and a receiver disposed on at least one of the first wall or the second wall and configured to detect an obstruction in the entryway.

6. The elevator car system of claim 1, wherein the supplemental obstruction sensor comprises a transmitter for transmitting a signal and a receiver for receiving the signal, and wherein the supplemental obstruction sensor is configured to transmit an obstruction indication based on determining that the receiver has not received the signal during a predetermined period of time.

7. The elevator car system of claim 6, wherein the supplemental obstruction sensor is communicatively coupled to at least one elevator car sensor and is configured to transmit an obstruction indication based on determining that the elevator car is substantially stopped and located within a predetermined distance from the elevator car sensor.

8. The elevator, car system of claim 1, wherein the supplemental obstruction sensor is a first supplemental obstruction sensor, and the elevator car system comprises one or more second supplemental obstruction sensors located on the other floors of the plurality of floors.

9. A method of operating an elevator door of an elevator car, the elevator car configured to travel between and stop on a plurality of floors, the elevator door capable of opening and closing along a pathway, wherein the method comprises:

receiving an instruction to close the elevator door;

detecting a proximate obstruction based on determining that the elevator car is substantially stopped and located on a floor of the plurality of floors and, by a supplemental obstruction sensor, detecting an obstruction on the floor external to both the elevator car and the elevator door; and at least one of modifying or overriding the instruction based on detecting the proximate obstruction.

10. The method of claim 9, wherein determining the proximate obstruction comprises:

determining that the supplemental obstruction sensor has detected an obstruction on the floor external to the elevator car and the door; and upon determining that the supplemental obstruction sensor has detected the proximate obstruction, determining that the elevator car is substantially stopped and located on the floor.

11. The method of claim 9, wherein determining the proximate obstruction comprises:

determining that the elevator car is substantially stopped and located on the floor; and upon determining the elevator car is substantially stopped and located on the floor, determining that the supplemental obstruction sensor has detected the proximate obstruction on the floor external to the elevator car and the door.

12. The method of claim 9, wherein determining the proximate obstruction comprises:

receiving detection input indicating that the supplemental obstruction sensor has detected the proximate obstruction on the floor;

receiving location input indicating that the elevator car is substantially stopped and located on the floor; and determining that the elevator is stopped and located on the floor having the proximate obstruction based on the detection input and the location input.

13. The method of claim 9, wherein each floor of the plurality of floors has an entryway defined by a first wall and a second wall and configured to provide a user access to the elevator car interior when the door is in an open configuration, and wherein the supplemental obstruction sensor comprises a transmitter and a receiver disposed on at least one of the first wall or the second wall and configured to detect when an obstruction is in the entryway.

14. The method of claim 9, wherein the first obstruction sensor is in a recessed channel.

15. A method of operating an elevator door of an elevator car, the elevator car configured to travel between and stop on a plurality of floors, the elevator door capable of opening and closing along a pathway, wherein each of the plurality of floors has an external portion adjacent to the pathway and external to both the elevator car and the elevator door, wherein the method comprises:

receiving an instruction to close the elevator door;

determining whether a first obstruction sensor has detected a first obstruction;

determining whether both a supplemental obstruction sensor has detected a second obstruction on a floor of the plurality of floors and the elevator car is substantially stopped at the floor; and preventing or modifying a closing of the elevator door based on at least one of: determining that the first obstruction sensor has detected the first obstruction, and determining that the supplemental obstruction sensor has detected the second obstruction on the floor and the elevator car is substantially stopped on the floor.

16. The method of claim 15, wherein the determining whether both the supplemental obstruction sensor has detected the second obstruction on the floor and the elevator car is substantially stopped and located on the floor comprises:

determining whether the supplemental obstruction sensor has detected an obstruction on any of the floors of the plurality of floors; and based on determining that the supplemental obstruction sensor has detected an obstruction, determining if the elevator car is substantially stopped and located on the floor.

17. The method of claim 15, wherein the method further comprises:

receiving location input from an elevator car sensor indicating a position and speed of the elevator car;

receiving obstruction input from the supplemental obstruction sensor indicating an obstruction proximate to the supplemental obstruction sensor;

determining that the supplemental obstruction sensor has detected an obstruction on the floor at which the elevator car is substantially stopped; and wherein the determining whether both the supplemental obstruction sensor has detected the obstruction on the floor and the elevator car is substantially stopped on the floor is based on receiving the obstruction signal.

18. The method of claim 15, wherein for each floor of the plurality of floors, the external portion comprises an entryway defined by a first wall and a second wall and configured to provide a user access to the elevator car interior when the door is in an open configuration, wherein the supplemental obstruction sensor comprises a transmitter and a receiver disposed on at least one of the first wall or the second wall and configured to detect when an obstruction is in the entryway.

19. The method of claim 15, wherein the first obstruction sensor is disposed in a recessed channel.

20. The method of claim 15, wherein the supplemental obstruction sensor comprises a transmitter for transmitting a signal, a receiver for receiving the signal, and at least one elevator car sensor for detecting a location of the elevator car, and wherein the supplemental obstruction sensor is configured to transmit an obstruction indication based on determining that the receiver has not received the signal during a predetermined period of time and the elevator car is substantially stopped and located within a predetermined distance from the elevator car sensor.

* * * * *